US009591400B2

(12) United States Patent
Ohnishi

(10) Patent No.: US 9,591,400 B2
(45) **Date of Patent: *Mar. 7, 2017**

(54) INSTALLATION STRUCTURE FOR ACOUSTIC TRANSDUCER

(71) Applicant: Yamaha Corporation, Hamamatsu-Shi, Shizuoka-Ken (JP)

(72) Inventor: Kenta Ohnishi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/565,887

(22) Filed: Dec. 10, 2014

(65) Prior Publication Data

US 2015/0163575 A1 Jun. 11, 2015

(30) Foreign Application Priority Data

Dec. 11, 2013 (JP) ..... 2013-255848

(51) Int. Cl.
*H04R 1/00* (2006.01)
*H04R 1/46* (2006.01)
(Continued)

(52) U.S. Cl.
CPC ..... *H04R 1/46* (2013.01); *G10H 1/32* (2013.01); *G10H 3/22* (2013.01); *H04R 7/04* (2013.01); *H04R 9/043* (2013.01)

(58) Field of Classification Search
CPC ..... H04R 1/00
(Continued)

(56) References Cited

U.S. PATENT DOCUMENTS 3,015,366 A 1/1962 Bishop
6,965,679 B1 11/2005 Lopez Bosio et al.
(Continued)

FOREIGN PATENT DOCUMENTS

DE 3831187 A1 3/1990
EP 1 079 664 A2 2/2001
(Continued)

OTHER PUBLICATIONS

Non-Final Office Action mailed Nov. 10, 2015 in U.S. Appl. No. 14/762,611.
(Continued)

*Primary Examiner* — Matthew Eason
*Assistant Examiner* — Phan Le
(74) *Attorney, Agent, or Firm* — Blank Rome LLP

(57) ABSTRACT

An installation structure for an acoustic transducer that operates in accordance with an audio signal to thereby vibrating a vibrated body in a first direction for permitting the vibrated body to generate sounds, including: a magnetic-path forming portion fixedly disposed relative to a fixedly supporting portion; a movable unit having an electromagnetic coupling portion electromagnetically coupled to the magnetic-path forming portion and configured to vibrate in the first direction when the electromagnetic coupling portion is driven by the magnetic-path forming portion in response to a drive signal based on the audio signal; a connector fixed to the vibrated body and connecting the movable unit to the vibrated body for transmitting vibration of the movable unit to the vibrated body; and at least two restricting mechanisms fixedly disposed relative to the fixedly supporting portion for restricting a movement of the movable unit in a second direction intersecting the first direction.

10 Claims, 11 Drawing Sheets

(51) Int. Cl.

| | |
|---|---|
| ***G10H 1/32*** | (2006.01) |
| ***G10H 3/22*** | (2006.01) |
| *H04R 7/04* | (2006.01) |
| *H04R 9/04* | (2006.01) |

(58) Field of Classification Search
USPC ..... 381/162, 386
See application file for complete search history.

(56) References Cited

U.S. PATENT DOCUMENTS

| | | | | |
|---|---|---|---|---|
| 7,085,391 | B1 | 8/2006 | Yamaya | |
| 2003/0015086 | A1* | 1/2003 | Katz | G10H 1/32 84/644 |
| 2005/0180587 | A1 | 8/2005 | Lopez Bosio et al. | |
| 2006/0115107 | A1 | 6/2006 | Vincent et al. | |
| 2006/0126886 | A1 | 6/2006 | Combest | |
| 2009/0211425 | A1* | 8/2009 | Jones | G10C 5/005 84/243 |
| 2013/0061733 | A1 | 3/2013 | Ohnishi et al. | |

FOREIGN PATENT DOCUMENTS

| | | | |
|---|---|---|---|
| EP | 1 227 700 | A1 | 7/2002 |
| EP | 2 571 016 | A2 | 3/2013 |
| EP | 2 793 221 | A1 | 10/2014 |
| JP | 59-50031 | A | 3/1984 |
| JP | H04-500735 | A | 2/1992 |
| JP | 2000-315088 | A | 11/2000 |
| JP | 2008-298992 | A | 12/2008 |
| JP | 2010/007835 | A | 1/2010 |
| JP | 2010-007835 | A | 1/2010 |
| JP | 2012-230406 | A | 11/2012 |
| TW | 466468 | B | 12/2001 |
| WO | WO 83/03022 | A1 | 9/1983 |
| WO | WO-90/03025 | A1 | 3/1990 |
| WO | WO-2013/089239 | A1 | 6/2013 |
| WO | WO 2014/115482 | A1 | 7/2014 |

OTHER PUBLICATIONS

Office Action of Taiwan application No. 102147003 with English translation.

Communication pursuant to Article 94(3) from EP Application No. 14 197 139.0-1910 dated Sep. 20, 2016.

Supplemental European Search Report from EP Patent Application No. 13872580.9 dated Sep. 28, 2016.

Notification of Reasons for Refusal from Japanese Patent Application No. 2013-255848 dated Dec. 20, 2016 and translation of Notification.

* cited by examiner

INSTALLATION STRUCTURE FOR ACOUSTIC TRANSDUCER

CROSS REFERENCE TO RELATED APPLICATION

The present application claims priority from Japanese Patent Application No. 2013-255848, which was filed on Dec. 11, 2013, the disclosure of which is herein incorporated by reference in its entirety.

BACKGROUND OF THE INVENTION

Field of the Invention

The present invention relates to an installation structure for an acoustic transducer configured to operate in accordance with an audio signal for thereby vibrating a vibrated body so as to permit the vibrated body to generate sounds.

Description of Related Art

Conventional devices such as keyboard musical instruments are known in which an acoustic transducer operates in accordance with an audio signal to thereby vibrate a vibrated body, so that the vibrated body generates sounds. For instance, a keyboard musical instrument is provided with: the acoustic transducer fixed to a back post via a support member; and a movable unit connected to a soundboard that functions as the vibrated body to be vibrated. The movable unit (vibrating unit) is configured to vibrate when an electric current in accordance with the audio signal is supplied to a coil. The vibration of the movable unit is transmitted to the soundboard, so that the soundboard is vibrated to thereby generate sounds.

The following Patent Literature 1 describes an installation structure for the acoustic transducer provided in the keyboard musical instrument. In the disclosed structure, the movable unit in the form of a rod-like hammer is electromagnetically coupled to a magnetic-path forming portion having a magnet, a core, and so on. When an electric current is supplied to the coil, the movable unit reciprocates in its axial direction, so that the movable unit vibrates. The movable unit is fixedly bonded at its distal end portion to a flange fixed to the soundboard.

Patent Literature 1: Japanese Unexamined Patent Application Publication (Translation of PCT Application) No. 04-500735

SUMMARY OF THE INVENTION

In a typical acoustic transducer of a voice coil type, however, a bobbin around which a coil is wound is disposed so as to be spaced apart from a bottom yoke and a top plate that constitute a magnetic-path forming portion to leave a very narrow space therebetween. The bobbin functioning as a part of the movable unit is supported by a damper so as to be movable in a vibration direction while a movement of the bobbin in the horizontal direction perpendicular to the vibration direction is restricted by the damper.

If the movable unit is inclined or displaced in the horizontal direction against the restriction force by the damper, the movable unit and the magnetic-path forming portion would physically interfere with each other or electromagnetic coupling therebetween would fail, causing operation failure of the movable unit. In this instance, there may be a risk that the vibration is not appropriately transmitted or sounds are not appropriately generated. That is, the function of the acoustic transducer to vibrate the vibrated body cannot be maintained. In addition, the interference between the bobbin or the coil and the bottom yoke or the top plate would cause not only noise but also damage in those components.

When focusing on a portion of the movable unit that is located near the magnetic-path forming portion, it is noted that the inclination of the movable unit and the displacement of the movable unit in the horizontal direction may be caused by buckling or flexure of a drive shaft that is caused when a drive force is transmitted. That is, a rod-like drive shaft that extends from the movable unit for driving the vibrated body such as a soundboard tends to suffer from bucking or flexure especially when the drive shaft is long and thin and accordingly does not have sufficient rigidity.

Further, the inclination of the movable unit and the displacement of the movable unit in the horizontal direction may be caused due to changes over time. That is, the vibrated body such as the soundboard may suffer from a dimensional change or deformation over time due to influences of the temperature and the humidity. In particular when the vibrated body or a flange to which the movable unit is connected is displaced in the horizontal direction, the distal end portion of the movable unit is displaced in the horizontal direction together with the flange. When the amount of displacement becomes large to a certain extent, the portion of the movable unit near the magnetic-path forming portion tends to be inclined or displaced in the horizontal direction.

The present invention has been developed to solve the conventionally experienced problems. It is therefore an object of the invention to provide an installation structure for an acoustic transducer that enables a movable unit to accurately move in a vibration direction and thus ensures appropriate electromagnetic coupling between a magnetic-path forming portion and an electromagnetic coupling portion for maintaining an appropriate vibrating function of the acoustic transducer.

The above-indicated object may be attained according to a principle of the invention, which provides, an installation structure for an acoustic transducer (50) configured to operate in accordance with an audio signal for thereby vibrating a vibrated body (7) in a first direction, so as to permit the vibrated body to generate sounds, comprising: a magnetic-path forming portion (52) fixedly disposed relative to a fixedly supporting portion (9) and forming a magnetic path; a movable unit (100) having an electromagnetic coupling portion (EM) electromagnetically coupled to the magnetic-path forming portion, the movable unit being configured to vibrate in the first direction when the electromagnetic coupling portion is driven by the magnetic-path forming portion in response to a drive signal based on the audio signal; a connector (110) fixed to the vibrated body, the connector connecting the movable unit to the vibrated body for transmitting vibration of the movable unit to the vibrated body; and at least two restricting mechanisms (130, 53) fixedly disposed relative to the fixedly supporting portion and configured to restrict a movement of the movable unit in a second direction that intersects the first direction.

The reference numerals in the brackets attached to respective constituent elements in the above description correspond to reference numerals used in the following embodiment and modified examples to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

There will be explained one embodiment of the invention with reference to the drawings.

Figure 1:
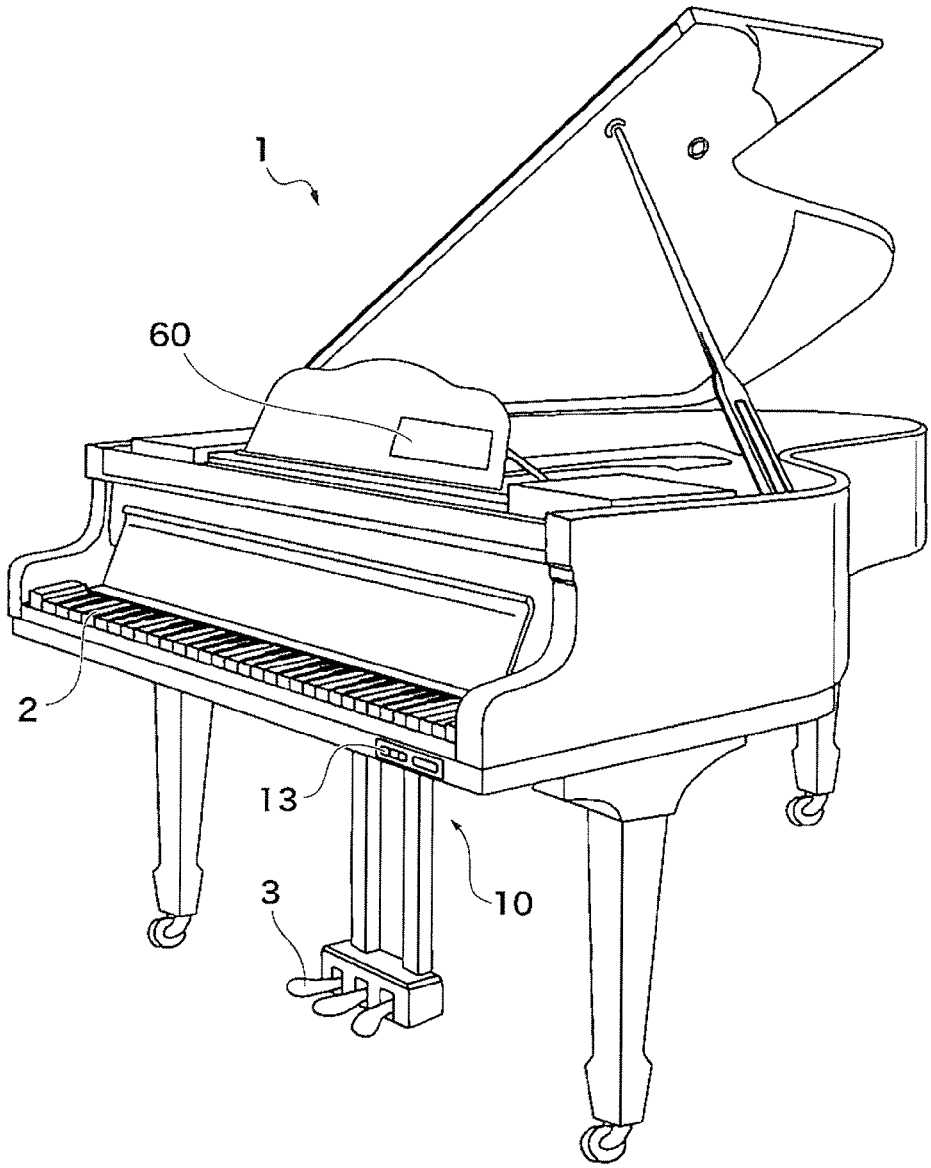
FIG. 1 is a perspective view showing an external appearance of a grand piano to which is applied an installation structure for an acoustic transducer according to one embodiment of the invention.

The perspective view of FIG. 1 shows a keyboard musical instrument in the form of a grand piano 1 as one example of devices and musical instruments to which is applied an installation structure for an acoustic transducer according to one embodiment of the invention. The acoustic transducer is configured to operate in accordance with an audio signal for thereby vibrating a vibrated body, so as to permit the vibrated body to generate sounds. A soundboard 7 is illustrated as one example of the vibrated body to be vibrated. It is noted the devices to which the present installation structure is applied is not limited to the grand piano 1 and the vibrated body is not limited to the soundboard 7. That is, the invention is applicable to any structure in which the acoustic transducer is driven in accordance with a drive signal based on the audio signal and the vibrated body is thereby vibrated for generating sounds.

The grand piano 1 has a keyboard and pedals 3 on its front side. The keyboard has a plurality of keys 2 that are operated by a performer (user) for performance. The grand piano 1 further has a controller 10 having an operation panel 13 on its front surface portion and a touch panel 60 provided on a music stand. User's instructions can be input to the controller 10 by a user's operation on the operation panel 13 and the touch panel 60.

Figure 2:
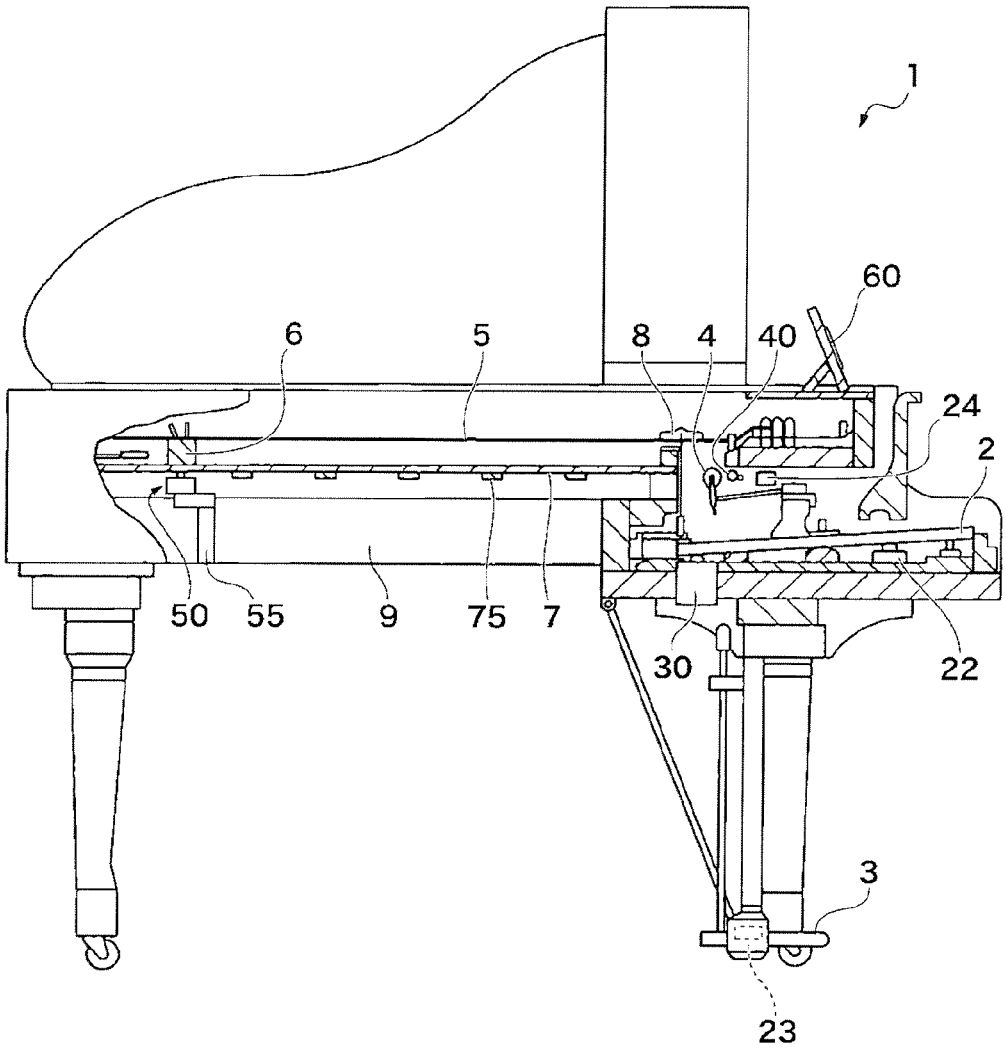
FIG. 2 is a cross-sectional view showing an internal structure of the grand piano.

In the cross-sectional view of FIG. 2 showing an internal structure of the grand piano 1, structures provided for each of the keys 2 are illustrated focusing on one key 2, and illustration of the structures for other keys 2 is omitted. A key drive unit 30 is provided below a rear end portion of each key 2 (i.e., on a rear side of each key 2 as viewed from the user who plays the piano 1 on the front side of the piano 1). The key drive unit 30 drives the corresponding key 2 using a solenoid.

The key drive unit 30 drives the solenoid in accordance with a control signal sent from the controller 10. That is, the key drive unit 30 drives the solenoid such that a plunger moves upward to reproduce a state similar to that when the user has depressed the key and such that the plunger moves downward to reproduce a state similar to that when the user has released the key.

Strings 5 and hammers 4 are provided so as to correspond to the respective keys 2. When one key 2 is depressed, the corresponding hammer 4 pivots via an action mechanism (not shown), so as to strike the string(s) 5 provided for the key 2. A damper 8 moves in accordance with a depression amount of the key 2 and a step-on amount of a damper pedal among the pedals 3, such that the damper 8 is placed in a non-contact state in which the damper 8 is not in contact with the string(s) 5 or in a contact state in which the damper 8 is in contact with the string(s) 5. A stopper 40 operates when a string-striking preventive mode is set in the controller 10. More specifically, the stopper 40 stops an upward movement of the corresponding damper 4 to strike the string(s) 5, thereby preventing the string(s) 5 from being struck by the hammer 4.

Key sensors 22 are provided for the respective keys 2. Each key sensor 22 is disposed below the corresponding key 2 to output, to the controller 10, a detection signal in accordance with the behavior of the corresponding key 2. Hammer sensors 24 are provided for the respective hammers 4. Each hammer sensor 24 outputs, to the controller 10, a detection signal in accordance with the behavior of the corresponding hammer 4. Pedal sensors 23 are provided for the respective pedals 3. Each pedal sensor 23 outputs, to the controller 10, a detection signal in accordance with the behavior of the corresponding pedal 3.

While not shown, the controller 10 includes a CPU, a ROM, a RAM, a communication interface, and so on. The CPU executes control programs stored in the ROM for enabling the controller 10 to perform various controls.

The soundboard 7 is a wooden plate-shaped member, and soundboard ribs 75 and bridges 6 are attached to the soundboard 7. The strings 5 stretched under tension partially engage the bridges 6. In this structure, vibration of the soundboard 7 is transmitted to the strings 5 via the bridges 6 while vibration of the strings 5 is transmitted to the soundboard 7 via the bridges 6.

In the grand piano 1, acoustic transducers 50 are connected to the soundboard 7 such that each acoustic transducer 50 is supported by a corresponding support member 55 connected to a back post 9 as one example of a fixedly supporting portion. Each support member 55 is formed of metal such as an aluminum material. The back posts 9 cooperate with a frame to support the tension of the strings 5 and constitute a part of the grand piano 1.

Figure 3:
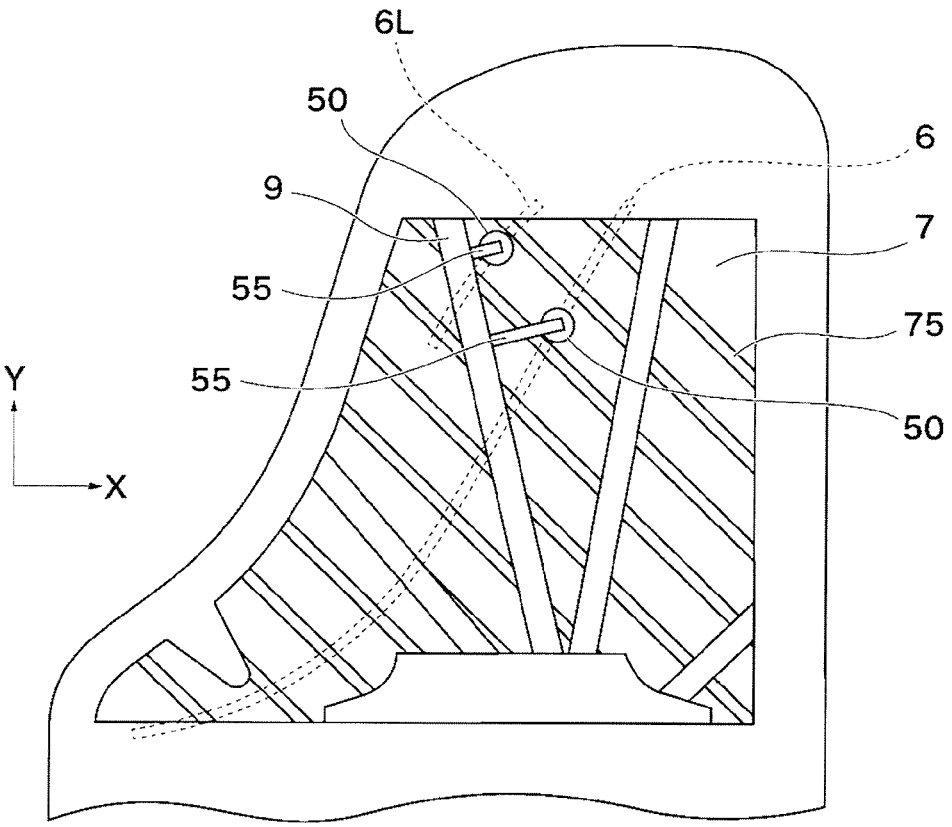
FIG. 3 is a view showing a back surface of a soundboard for explaining positions at which the acoustic transducers are installed.

FIG. 3 is a view showing a back surface of the soundboard 7 for explaining positions at which the acoustic transducers 50 are installed.

Each acoustic transducer 50 is connected to the soundboard 7 and is disposed between adjacent two of a plurality of soundboard ribs 75 attached to the soundboard 7. In FIG. 3, a plurality of, e.g., two acoustic transducers 50 having the same structure are connected to the soundboard 7. Only one acoustic transducer 50 may be connected to the soundboard 7. Each acoustic transducer 50 is disposed at a position as close as possible to the bridge 6. In the present embodiment, the acoustic transducer 50 is disposed at a position of the back surface of the soundboard 7 at which the acoustic transducer 50 is opposed to the bridge 6 with the soundboard 7 interposed therebetween. In the following explanation, a left-right direction, a front-rear direction, and an up-down (vertical) direction as viewed from a performer's side of the grand piano 1 are respectively referred to as "X-axis direction", "Y-axis direction" and "Z-axis direction". The Z-axis direction is one example of a first direction. The X-axis direction and the "Y-axis direction (X-Y direction) correspond to the horizontal direction. The X-Y direction is one example of a second direction.

Figure 4:
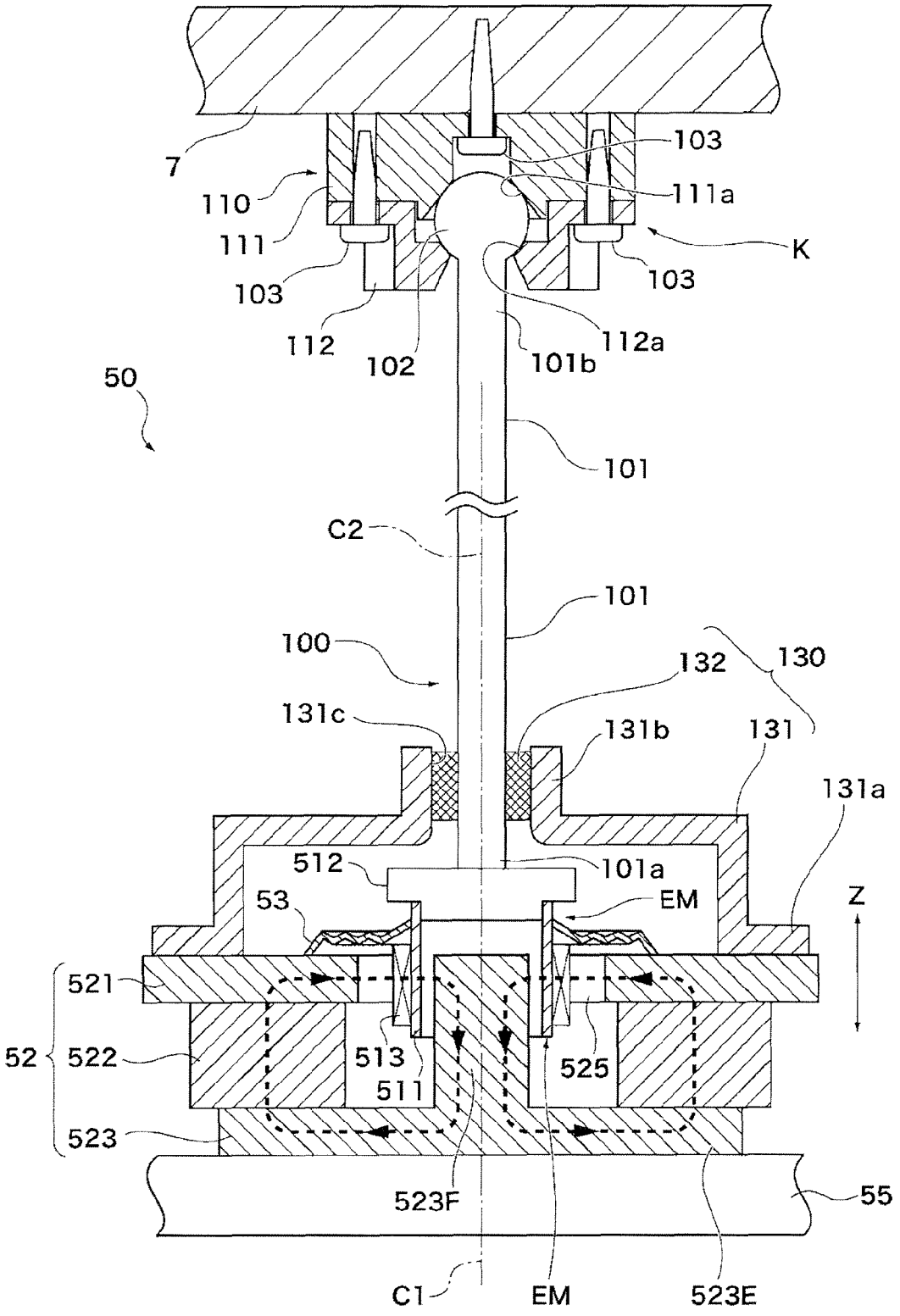
FIG. 4 is a vertical cross-sectional view of the acoustic transducer.

FIG. 4 is a vertical cross-sectional view of the acoustic transducer 50. The acoustic transducer 50 is an actuator of a voice-coil type and is mainly constituted by a magnetic-path forming portion 52 and a movable unit (vibrating unit) 100. The movable unit 100 includes a rod portion 101, a cap 512, a bobbin 511, and a voice coil 513. The bobbin 511 having an annular shape is fixedly fitted on a lower portion of the cap 512. The voice coil 513 is constituted by conductor wires wound around the outer circumferential surface of the bobbin 511. The voice coil 513 converts, into vibration, changes in an electric current flowing in a magnetic field formed by the magnetic-path forming portion 52. The cap 512, the bobbin 511 and the voice coil 513 constitute an electromagnetic coupling portion EM that is electromagnetically coupled to the magnetic-path forming portion 52.

A lower end portion, namely, a first end portion 101*a*, of the rod portion 101 is fixedly connected to the cap 512 of the electromagnetic coupling portion EM, and the rod portion 101 extends in the Z-axis (vertical) direction. A second-end-portion connector 110 is fixed to a lower (back) surface of the soundboard 7. The second-end-portion connector 110 connects an upper end portion, namely, a second end portion 101*b*, of the rod portion 101 to the soundboard 7 so as to transmit vibration of the movable unit 100 to the soundboard 7.

The second-end-portion connector 110 has a ball joint structure having a pointer member 111 and a chuck member 112. A spherical portion 102 is formed at the second end portion 101*b* of the rod portion 101. The pointer member 111 is fixed to the soundboard 7 by a screw 103, and the chuck member 112 is fixed, at its flange, to the pointer member 111 by screws 103.

The spherical portion 102 of the rod portion 101 is disposed between a tapered surface 111*a* of the pointer member 111 and a tapered surface 112*a* of the chuck member 112. The chuck member 112 is fixedly fastened to the pointer member 111, whereby the position of the spherical portion 102 in the Z-axis direction is determined or defined by the tapered surface 111*a* and the tapered surface 112*a*.

When the pointer member 111 is displaced, by a displacement of the soundboard 7, in a direction that includes a component in the horizontal direction, namely, in a direction different from or intersecting a vibration direction, the spherical portion 102 can accordingly rotate about an axis perpendicular to the Z axis (e.g., the X axis or the Y axis) in the tapered surfaces 111*a*, 112*a*. The second-end-portion connector 110 and the spherical portion 102 constitute a permission mechanism K. Here, the vibration direction means a direction in which the movable unit 100 vibrates.

The permission mechanism K is one example of a mechanism for permitting at least a portion of the movable unit 100 that is near the second-end-portion connector 110, mainly the second end portion 101*b* to be inclined with respect to the Z-axis direction when the second-end-portion connector 110 is displaced relative to the back post 9 within a predetermined range. That is, the permission mechanism K functions as a joint portion that permits the second end portion 101*b* to rotate about any axis perpendicular to the Z axis while the spherical portion 102 serves as a pivot center. The second end portion 101*b* can be inclined relative to an axis C1 corresponding to the Z axis owing to bending at the permission mechanism K. The motion that causes bending at the permission mechanism K is substantially a pivotal motion.

The rod portion 101 is formed of metal, for instance. While the pointer member 111 and the chuck member 112 are formed of resin, for instance, those members 111 112 may be formed of metal.

The magnetic-path forming portion 52 includes a top plate 521, a magnet 522, and a yoke 523 that are arranged in this order from the upper side. The electromagnetic coupling portion EM is supported by a damper 53 (as one example of a first restricting mechanism) such that the electromagnetic coupling portion EM can be displaced in the Z-axis direction without contacting the magnetic-path forming portion 52. The damper 53 is formed of fiber or the like and has a disc-like shape. The damper 53 has a waved shape like bellows at its disc-like portion. The damper 53 is attached at its outer peripheral end to the upper surface of the top plate 521 and at its inner peripheral end to the electromagnetic coupling portion EM. The magnetic-path forming portion 52 is fixedly disposed relative to the back post 9 such that the yoke 523 is fixed to the support member 55 by screws or the like, for instance. That is, the magnetic-path forming portion 52 is in a fixed state relative to the back post 9.

The top plate 521 is formed of a soft magnetic material such as soft iron and has a disc-like shape having a central hole. The yoke 523 is formed of a soft magnetic material such as soft iron. The yoke 523 is constituted by a disc portion 523E and a cylindrical portion 523F having an outer diameter smaller than that of the disc portion 523E. The disc portion 523E and a cylindrical portion 523F are formed integrally such that the axes of the disc portion 523E and the cylindrical portion 523F are aligned with each other. The outer diameter of the cylindrical portion 523F is smaller than an inner diameter of the top plate 521. The magnet 522 is a doughnut-shaped permanent magnet and has an inner diameter larger than the inner diameter of the top plate 521. The cylindrical portion 523F is loosely fitted in a hollow portion of the bobbin 511.

The axes of the top plate 521, the magnet 522, and the yoke 523 are aligned with one another and coincide with the axis C1 of the magnetic-path forming portion 52. This arrangement forms a magnetic path shown by arrows in the broken line in FIG. 4, The electromagnetic coupling portion EM is disposed such that the voice coil 513 is located in a space between the top plate 521 and the cylindrical portion 523F, i.e., in a magnetic-path space 525.

The acoustic transducer 50 according to the present embodiment has, in addition to the damper 53, a restricting mechanism 130 (as one example of a second restricting mechanism) for restricting a movement of the movable unit 100 in the Z-axis direction at an engaging position (at which the restricting mechanism 130 engages the movable unit 100) while permitting a movement of the movable unit 100 in the Z-axis direction. The damper 53 and the restricting mechanism 130 are spaced apart from each other in the Z-axis direction. The restricting mechanism 130 has a bridge portion 131 (as one example of a holding portion) and a contact member 132 (as one example of an engaging portion). The bridge portion 131 is formed by bending a metal plate, for instance, and may have any shape in plan view. For instance, the bridge portion 131 has a circular or rectangular shape in plan view. The bridge portion 131 has an outer peripheral portion 131*a* fixed to the top plate 521 and an inner peripheral portion formed to extend upward by burring so as to provide a holding portion 131*b*. In this structure, the bridge portion 131 is fixed to the back post 9 via the magnetic-path forming portion 52 and extends to a position in the Z-axis direction at which the bridge portion 131 is closer to the soundboard 7 than the damper 53 is to the soundboard 7. The contact member 132 fixed to the holding portion 131*b* restricts the movement of the movable unit 100 in a direction intersecting the Z axis at a position in the Z-axis direction at which the contact member 132 is closer to the soundboard 7 than the damper 53 is to the soundboard 7. Thus, the damper 53 and the restricting mechanism 130 engage the movable unit 100 at mutually different positions in the Z-axis direction. The contact member 132 having an annular shape is bonded to an inner diameter portion 131*c* of the holding portion 131*b*. The rod portion 101 of the movable unit 100 passes through a through-hole of the contact member 132.

The electromagnetic coupling portion EM is positioned relative to the horizontal direction, i.e., the X-Y direction, by the damper 53 and the restricting mechanism 130 such that an axis C2 of the rod portion 101 that coincides with the axis of the movable unit 100 aligns with the axis C1 of the magnetic-path forming portion 52. Consequently, the damper 53 and the restricting mechanism 130 cooperate with each other to support the magnetic-path forming portion 52 such that the movable unit 100 is movable in the Z-axis direction that coincides with the vibration direction while the axis (C2) of the movable unit 100 is kept aligned with the axis C1 of the magnetic-path forming portion 52.

The contact member 132 functions as a bushing for preventing the rod portion 101 from moving in the horizontal direction at a position near the cap 512. The position in the Z-axis direction at which the contact member 132 engages the movable unit 100 is sufficiently closer to the magnetic-path forming portion 52 than to the soundboard 7.

A drive signal based on an audio signal is input from the controller 10 to the acoustic transducer 50. For instance, audio data stored in a storage portion (not shown) is read out by the controller 10, and the drive signal is generated on the basis of the read data. Alternatively, when the soundboard 7 is vibrated in accordance with a performance operation, the behaviors of the keys 2, the pedals 3, and the hammers 4 are detected respectively by the key sensors 22, the pedal sensors 23, and the hammer sensors 24, whereby the performance operation of the player is detected. On the basis of the detection results, the controller 10 generates performance information. The controller 10 subsequently generates an acoustic signal on the basis of the performance information. The acoustic signal is processed and amplified so as to be output to the acoustic transducer 50 as the drive signal.

When the drive signal is input to the voice coil 513, the voice coil 513 receives a magnetic force in the magnetic-path space 525, and the bobbin 511 receives a drive force in the Z-axis direction in accordance with the waveform indicated by the drive signal input to the voice coil 513. Consequently, the electromagnetic coupling portion EM is driven by the magnetic-path forming portion 52, so that the movable unit 100 (the electromagnetic coupling portion EM and the rod portion 101) vibrates in the Z-axis direction. When the movable unit 100 vibrates in the Z-axis direction, the vibration of the movable unit 100 is transmitted to the soundboard 7 by the second-end-portion connector 110, so that the soundboard 7 is vibrated and sounds generated by the vibration of the soundboard 7 are emitted in the air.

The contact member 132 is formed of a soft fiber member such as a felt or a cloth. When the movable unit 100 vibrates, the rod portion 101 slidingly moves in the through-hole of the contact member 132. Because the contact member 132 is formed of a soft fiber material, it is possible to reduce noise generated by friction between the contact member 132 and the rod portion 101. In this respect, the contact member 132 may be formed of resin or the like, and a portion thereof that contacts the rod portion 101 may be formed to have low surface roughness, for reducing the friction.

Alternatively, the contact member 132 may be formed of an elastic member such as rubber. In this case, the contact member 132 may be arranged not to be always held in a sliding contact with the rod portion 101 that is vibrating but to be always held in a close contact with the rod portion 101 that is vibrating. The amplitude of the vibration of the movable unit 100 is not so large. By designing the thickness, the shape, and the hardness of the contact member 132 such that the contact member 132 can be deformed following the movement of the movable unit 100 in the vibration direction, it is possible to avoid friction and noise from being generated.

The best way to ensure appropriate electromagnetic coupling between the magnetic-path forming portion 52 and the electromagnetic coupling portion EM is to align the axis C2 of the movable unit 100 and the axis C1 of the magnetic-path forming portion 52 with each other. In other words, the axis C2 and the axis C1 are in coaxial alignment with each other for appropriate electromagnetic coupling. Because the movable unit 100 vibrates with a small amplitude and a weight reduction of the movable unit 100 is desirable, it is sometimes difficult for the rod portion 101 to have a sufficiently large thickness. When a distance between the magnetic-path forming portion 52 and the soundboard 7 cannot be shortened, the length of the rod portion 101 is inevitably large. When the rod portion 101 is long and thin and accordingly does not have sufficient rigidity, the rod portion 101 suffers from buckling or flexure when the vibration is transmitted to the soundboard 7.

In the present embodiment, however, the restricting mechanism 130 is provided in addition to the known damper 53, thereby making it possible to restrict the movement of the movable unit 100 in the horizontal direction at mutually different two positions in the Z-axis direction. According to this structure, the movable unit 100 vibrates in the Z-axis direction without being inclined relative to the Z-axis direction at the two positions (i.e., restricted positions). Further, the contact member 132 restrains the movable unit 100 at a position sufficiently close to the magnetic-path forming portion 52, so that the contact member 132 serves as a guide for the movement of the movable unit 100 at the position close to the magnetic-path forming portion 52 and thus enables the movable unit 100, more specifically, a portion of the movable unit 100 near the magnetic-path forming portion, to accurately move in the vibration direction. Consequently, the magnetic-path forming portion 52 and the electromagnetic coupling portion EM can be electromagnetically coupled appropriately at all times.

According to the present embodiment, the movable unit 100 can be moved accurately in the vibration direction and the electromagnetic coupling between the magnetic-path forming portion 52 and the electromagnetic coupling portion EM can be ensured for maintaining an appropriate vibrating function.

The contact member 132 formed of a fiber member can prevent or reduce friction and noise. The contact member 132 formed of an elastic member can follow the movement of the movable unit 100, so that noise can be prevented or reduced.

Factors of hindering the alignment of the axis C2 of the movable unit 100 and the axis C1 of the magnetic-path forming portion 52 may include a dimensional change or deformation of the soundboard 7 due to changes over time. When the soundboard 7 suffers from the dimensional change or deformation in the horizontal direction, a portion to which the movable unit 100 is connected, in other words, the second-end-portion connector 110 that is fixedly disposed relative to the soundboard 7, may also be horizontally displaced.

When the second-end-portion connector 110 is displaced horizontally in known structures, the electromagnetic coupling portion EM cannot be sufficiently restrained only by the damper 53, causing not only a risk that the positional relationship between the electromagnetic coupling portion EM and the magnetic-path forming portion 52 becomes inappropriate, but also a risk that the first end portion 101*a* is inclined. In this instance, the positional relationship between the electromagnetic coupling portion EM and the magnetic-path forming portion 52 becomes inappropriate, and the movable unit 100 fails to vibrate appropriately. In the present embodiment, the restricting mechanism 130 suppresses the tendency of the first end portion 101*a* to incline. Nevertheless, it is difficult to deal with excessively large displacement of the second-end-portion connector 110.

In the present embodiment, the permission mechanism K is additionally provided. Even when the second-end-portion connector 110 is displaced, a portion of the rod portion 101 near the second-end-portion connector 110, namely, an upper portion of the rod portion 101 including the second end portion 101*b*, bears a substantial part of inclination of the movable unit 100 with respect to the Z-axis direction. Consequently, a force by which a lower portion of the rod portion 101 including the first end portion 101*a* is inclined does not become large, whereby the movement of the movable unit 100 in the horizontal direction can be sufficiently restricted by the damper 53 and the restricting mechanism 130 in a range near the magnetic-path forming portion 52. Thus, even when the soundboard 7 suffers from the dimensional change in a direction intersecting the vibration direction, the movable unit 100 can be accurately moved in the vibration direction and the electromagnetic coupling between the magnetic-path forming portion 52 and the electromagnetic coupling portion EM can be maintained for ensuring an appropriate vibrating function over a long time period.

Suppose the permission mechanism K is not provided and the second-end-portion connector 110 connects the second end portion 101*b* of the rod portion 101 to the soundboard 7 in such a manner that the second end portion 101*b* is not allowed to be inclined. Even in this arrangement, when the displacement of the soundboard 7 over time is small or when the rod portion 101 is sufficiently long, the damper 53 and the restricting mechanism 130 restrict the movement of the movable unit 100 in the horizontal direction at positions close to the magnetic-path forming portion 52, whereby the axis C2 of the movable unit 100 is kept in parallel with the Z axis in the range near the magnetic-path forming portion 52. Thus, the effect of restricting the movement of the movable unit 100 in the horizontal direction by the damper 53 and the restricting mechanism 130 is ensured in some occasions even without the permission mechanism K.

FIGS. 5A-5D show modified examples of the movable unit 100 suitably used when the permission mechanism K is not provided.

Figure 5A:
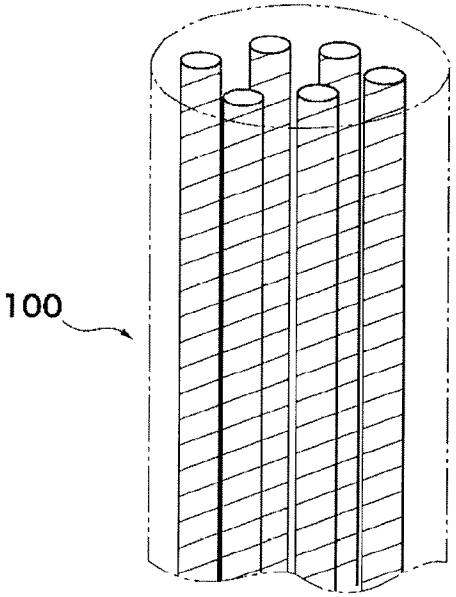
FIGS. 5A-5D are views showing movable units according to modified examples suitably used when the installation structure does not have a permission mechanism.
Figure 5B:
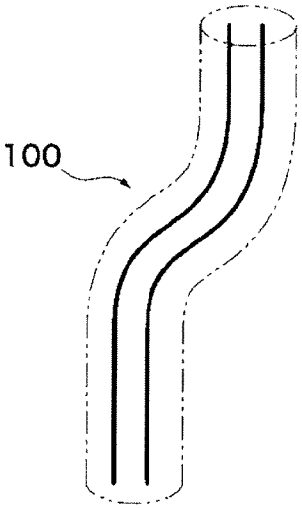

FIG. 5A is a perspective view of an end portion of the rod portion 101 in the movable unit 100 according to one modified example. The rod portion 101 of the modified example has an internal structure in which a plurality of iron cores extend in a soft resin as a base material. For instance, a carbon fiber or the like can be used. The thus formed rod portion 101 has flexibility in the horizontal direction while maintaining strength in the Z-axis direction. Accordingly, the rod portion 101 is bent as shown in FIG. 5B when the second-end-portion connector 110 is displaced in the horizontal direction relative to the back post 9.

Figure 5C:
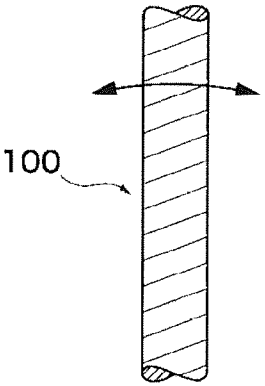
Figure 5D:
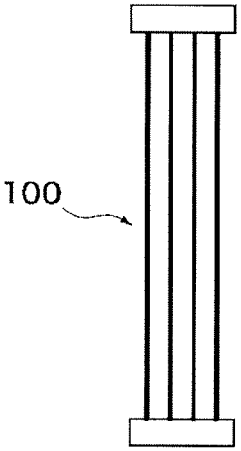

FIGS. 5C and 5D are side views of the rod portions 101 in the movable units 100 according to respective modified examples. In FIG. 5C, the rod portion 101 is constituted by a flexible shaft. In FIG. 5D, the rod portion 101 is formed by a plurality of wires whose opposite ends are fixed. In both of the modified examples, the rod portion 101 is bent when the second-end-portion connector 110 is displaced in the horizontal direction relative to the back post 9.

Consequently, the rod portion 101 is restricted by the damper 53 and the restricting mechanism 130 in the range near the magnetic-path forming portion 52 in all of the modified examples of FIGS. 5A-5D, so that the movable unit 100 appropriately vibrates in the Z-axis direction.

It is noted that the restricting mechanism 130 is fixedly disposed relative to the back post 9, namely, the restricting mechanism 130 is in a fixed state relative to the back post 9. In view of this, the restricting mechanism 130 need not be necessarily fixed to the top plate 521 but may be fixed to the support member 55, for instance.

The restricting mechanism 130 needs to engage the movable unit 100 at a position in the Z-axis direction different from a position at which the damper 53 engages the movable unit 100. A plurality of restricting mechanisms 130 may be provided so as to engage the movable unit 100 at mutually different positions in the Z-axis direction.

The permission mechanism K is provided on the movable unit 100 or the second-end-portion connector 110, so as to be disposed between: the soundboard 7; and the closest engaging position that is the closest to the second-end-portion connector 110 among engaging positions at which the damper 53 and the restricting mechanism/mechanisms 130 respectively engage the movable unit 100. The permission mechanism K is configured to permit inclination, relative to the Z-axis direction, of at least a portion of the movable unit 100 located on one of opposite sides of the closest engaging position that is nearer to the second-end-portion connector 110.

Figure 7:
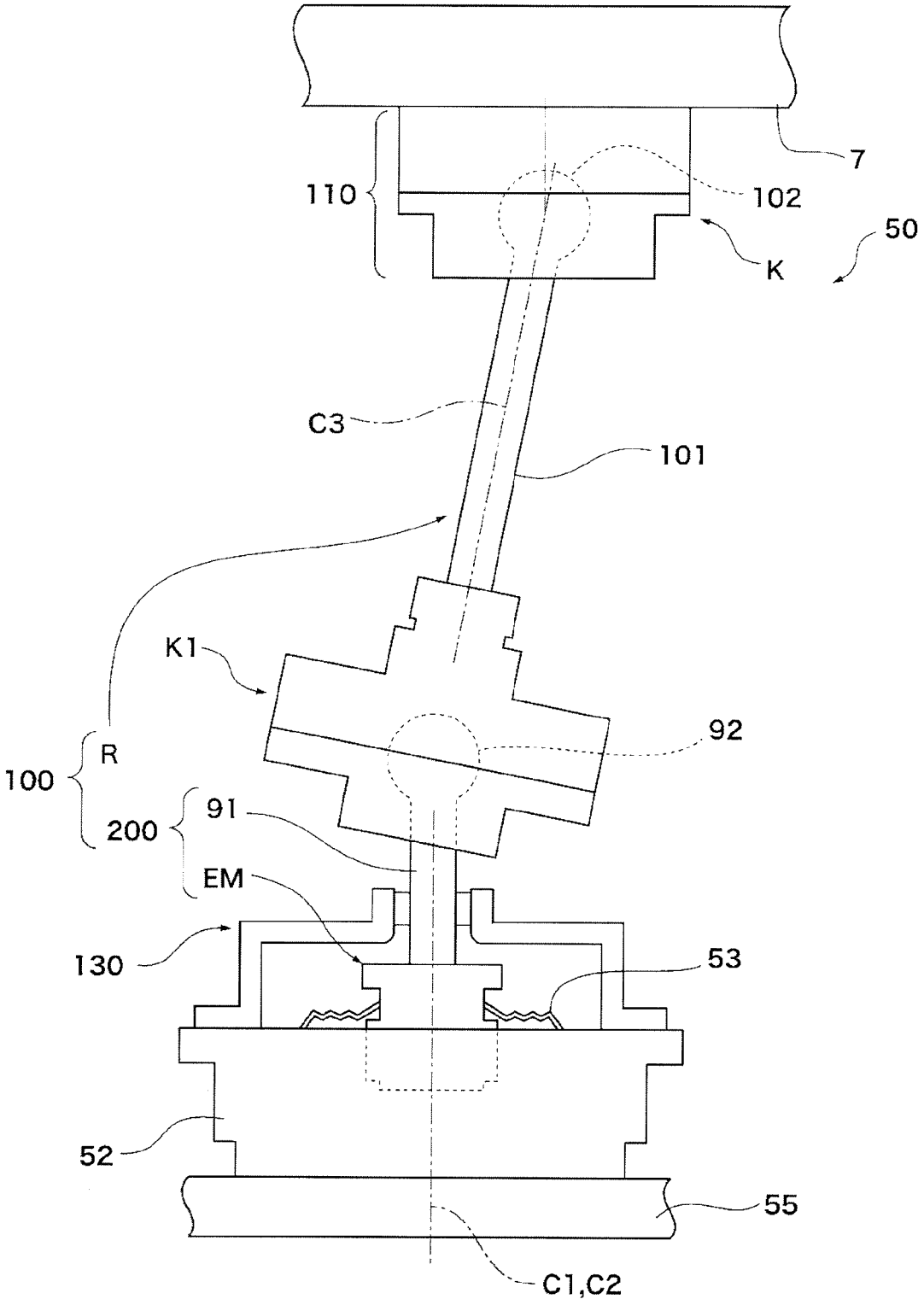
FIG. 7 is a side view of an acoustic transducer according to a modified example in which two permission mechanisms are provided.
Figure 8:
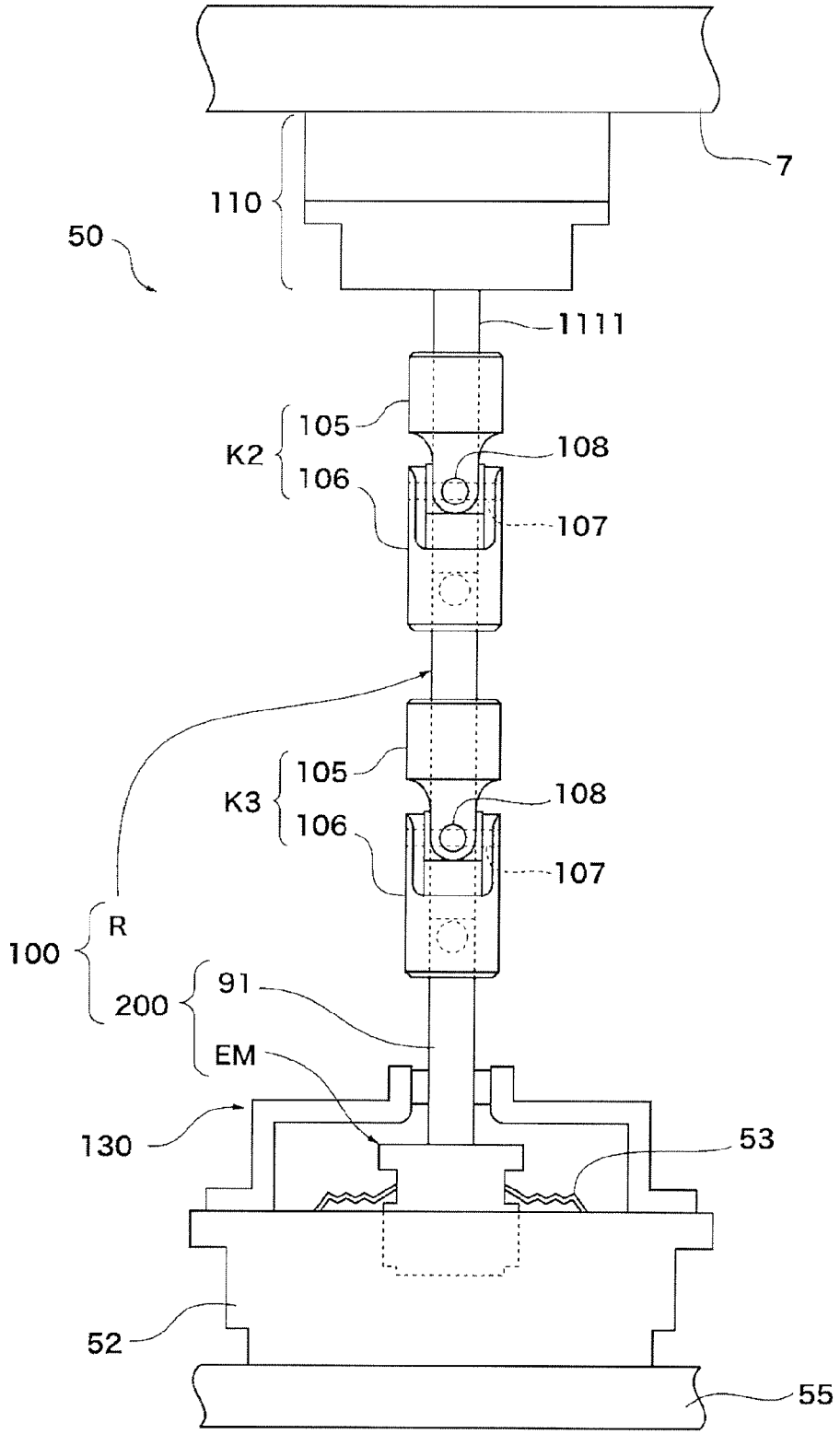
FIG. 8 is a side view of an acoustic transducer according to a modified example in which two permission mechanisms are provided on the movable unit.

When considering the function of the permission mechanism K to permit inclination of the movable unit 100, it is impossible for the permission mechanism K to unlimitedly deal with the horizontal displacement of the soundboard 7 in an instance where the soundboard 7 suffers from the horizontal displacement over time. Because the amount of displacement of the soundboard 7 over time can be estimated, it is required for the permission mechanism K to deal with the displacement in the estimated (predetermined) range. Form this viewpoint, various structures of the permission mechanism K are conceivable. Referring to FIGS. 6-8, modified examples of the permission mechanism K will be explained.

Figure 6A:
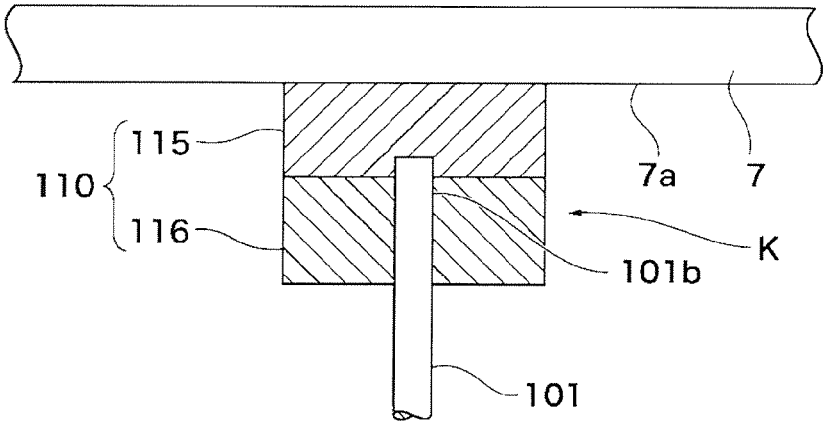
FIGS. 6A-6B are vertical cross-sectional views showing permission mechanisms according to modified examples.
Figure 6B:
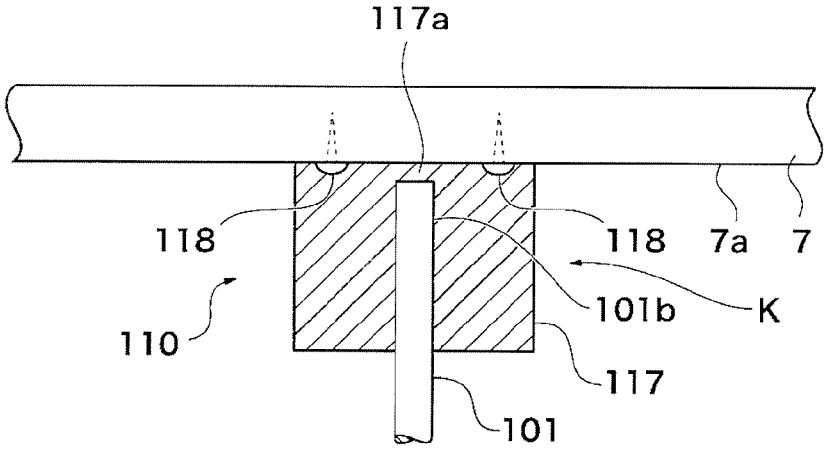

FIGS. 6A and 6B are vertical cross-sectional views of permission mechanisms according to respective modified examples.

In the permission mechanism K shown in FIG. 6A, the second-end-portion connector 110 is formed by superposing two materials having different hardness in the vertical direction. For instance, an upper resin portion 115 is fixed to a lower surface 7*a* of the soundboard 7 while a lower resin portion 116 is fixed to the resin portion 115. The resin portion 115 is harder than the resin portion 116. The second end portion 101*b* of the rod portion 101 is fixed to the resin portion 115 such that a distal end of the second end portion 101*b* is embedded in the resin portion 115 by a small amount. The second-end-portion connector 110 constituted by the resin portions 115, 116 can be provided according to an outsert molding process by double molding, for instance.

The resin portion 115 has hardness that permits the vibration of the movable unit 100 to be appropriately transmitted to the soundboard 7. The resin portion 116 has flexibility that permits deformation thereof following a horizontal displacement of a portion of the second end portion 101*b* fixedly embedded in the resin portion 116 when the embedded portion is displaced in the horizontal direction.

According to the above structure, when the second-end-portion connector 110, specifically, the resin portion 115, is displaced in the horizontal direction, a portion of the second end portion 101*b* that is fixed to the resin portion 115 is horizontally displaced together with the resin portion 115 while the other portion located below the portion fixed to the resin portion 115 rotates about an axis perpendicular to the Z axis owing to the flexibility of the resin portion 116. Thus, a portion of the rod portion 101 other than the portion thereof fixed to the resin portion 115 is permitted to be inclined relative to the Z axis without an excessively large force applied to the portion of the rod portion 101 other than the portion thereof fixed to the resin portion 115.

In the permission mechanism K shown in FIG. 6B, the second-end-portion connector 110 is formed of a soft material of one kind. That is, a resin portion 117 having the same degree of hardness as the resin portion 116 is fixed to the lower surface 7*a* of the soundboard 7 with screws 118 or the like. The second end portion 101*b* of the rod portion 101 is fixedly embedded deeply in the resin portion 117 while leaving a small thickness portion 117*a* having a suitable small thickness between the distal end of the second end portion 101*b* and the lower surface 7*a* of the soundboard 7. The thickness of the small thickness portion 117*a* is determined so as to permit the vibration of the movable unit 100 to be appropriately transmitted to the soundboard 7 in view of the softness of the resin portion 117.

According to the structure described above, when the second-end-portion connector 110, specifically, a part of the resin portion 117 that is in contact with the soundboard 7, is displaced in the horizontal direction, the rod portion 101 is permitted to be inclined relative to the Z axis owing to the flexibility of the resin portion 117 without an excessively large force applied to the rod portion 101.

FIG. 7 is a side view of the acoustic transducer 50 according to a modified example in which two permission mechanisms are provided.

In the acoustic transducer 50 shown in FIG. 7, the movable unit 100 is divided into a connecting member R and a vibration unit 200. The connecting member R and the vibration unit 200 are connected by a permission mechanism K1 so as to be bendable at the permission mechanism K1. Thus, the movable unit 100 includes the permission mechanism K1, in addition to the permission mechanism K of FIG. 4 explained above. Like the permission mechanism K, the permission mechanism K1 has a ball joint structure and functions as a joint portion. The vibration unit 200 has a rod portion 91 that protrudes from the electromagnetic coupling portion EM, and a spherical portion 92 provided at an upper end of the rod portion 91 is rotatable in the permission mechanism K1.

In the thus constructed acoustic transducer 50, even if the second-end-portion connector 110 is displaced in the horizontal direction, an axis C3 of the rod portion 101 is permitted to incline relative to the axis C1 of the magnetic-path forming portion 52 and the axis C2 of the movable unit 100 that are parallel to the Z axis owing to bending at the permission mechanisms K, K1, without an excessively large force applied to the rod portion 101. Consequently, a force by which the rod portion 91 is inclined does not become large, and it is thus possible to sufficiently restrict the movement of the movable unit 100 in the horizontal direction in the range near the magnetic-path forming portion 52 by the damper 53 and the restricting mechanism 130.

FIG. 8 is a side view of the acoustic transducer 50 according to a modified example in which two permission mechanisms are provided on the movable unit 100.

In this modified example, a soundboard-side rod portion 1111 is provided so as to extend downwardly from the second-end-portion connector 110 and is fixedly disposed relative to the soundboard 7. The movable unit 100 is constituted by the vibration unit 200 and the connecting member R. In the vibration unit 200, the rod portion 91 protrudes from the electromagnetic coupling portion EM.

The connecting member R is connected to the soundboard-side rod portion 1111 so as to be inclinable owing to bending at a permission mechanism K2 and is connected to the rod portion 91 so as to be inclinable owing to bending at a permission mechanism K3. Each of the permission mechanisms K2, K3 is constituted by a universal joint having engagement members 105, 106. The engagement members 105, 106 are rotatably supported by a shaft 107 so as to be pivotable about the X axis and by a shaft 108 so as to be pivotable about the Y axis.

In the thus constructed acoustic transducer 50, even if the soundboard-side rod portion 1111 is displaced in the horizontal direction together with the second-end-portion connector 110, the connecting member R is permitted to be inclined relative to the Z axis owing to bending at the permission mechanisms K2, K3 without an excessively large force applied to the connecting member R. Consequently, a force by which the rod portion 91 is inclined does not become large, and it is thus possible to sufficiently restrict the movement of the movable unit 100 in the horizontal direction in the range near the magnetic-path forming portion 52 by the damper 53 and the restricting mechanism 130.

Referring next to FIGS. 9-11, various modified examples of the restricting mechanism 130 will be explained.

Figure 9A:
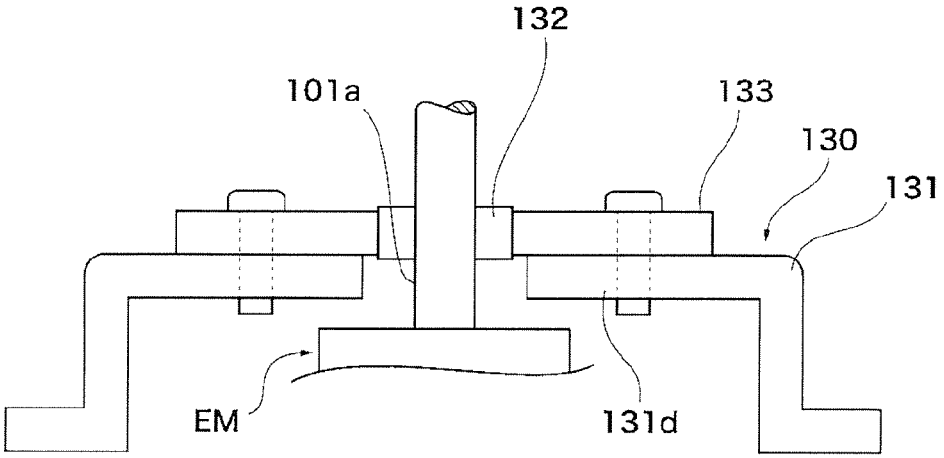
FIGS. 9A and 9B are schematic side views each showing a restricting mechanism in which a contact member is disposed differently from the embodiment of FIG. 4.
Figure 9B:
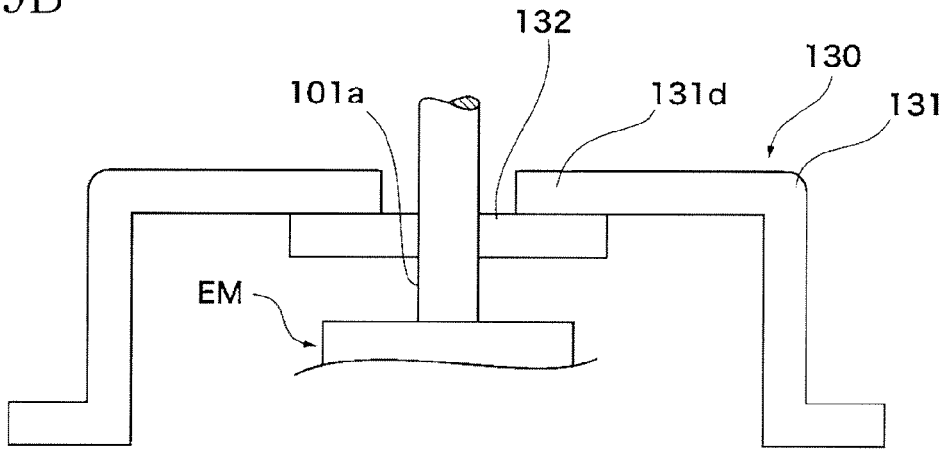

FIGS. 9A and 9B are schematic side views each showing the restricting mechanism 130 in which the contact member 132 is disposed differently from the embodiment of FIG. 4. In the modified example of FIG. 9A, an annular plate 133 formed of wood or resin is fixed by screws to an upper surface of an inner peripheral portion 131*d* of the bridge portion 131. The contact member 132 is fixed to an inner diameter portion of the plate 133. In the modified example of FIG. 9B, the contact member 132 is fixed directly to a lower surface of the inner peripheral portion 131*d* of the bridge portion 131.

In the embodiment and modified examples, it is not essential that the contact member 132 have a through-hole. The contact member 132 may be formed so as to surround a portion of the movable unit 100, e.g., the rod portion 101, in the horizontal direction.

FIGS. 10A-10B and FIGS. 11A-11B are schematic side views each showing the vicinity of the magnetic-path forming portion and the electromagnetic coupling portion in an instance in which the restricting mechanism 130 is formed and disposed differently from the embodiment of FIG. 4. In all of the examples of FIGS. 10A-10B and FIGS. 11A-11B, no member equivalent to the contact member 132 is provided, and the damper 53 is formed and disposed similarly to the embodiment of FIG. 4.

Figure 10A:
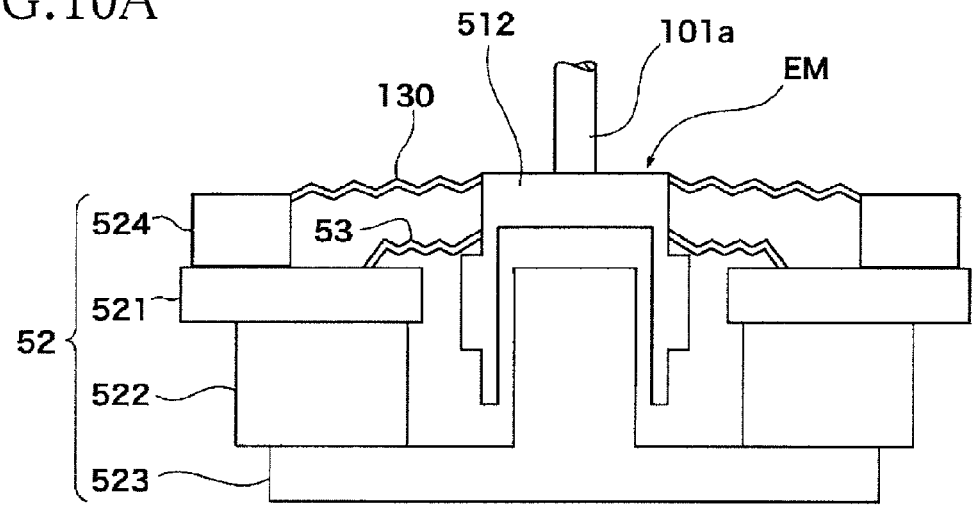
FIGS. 10A and 10B are schematic side views each showing the vicinity of a magnetic-path forming portion and an electromagnetic coupling portion in an instance in which the restricting mechanism is formed and disposed differently from the embodiment of FIG. 4.

In the example of FIG. 10A, the restricting mechanism 130 is provided so as to connect a base portion 524 fixed to the top plate 521 and the cap 512 to each other. The restricting mechanism 130 has a structure similar to that of the damper 53. That is, the arrangement of FIG. 10A has a dual damper structure.

Figure 10B:
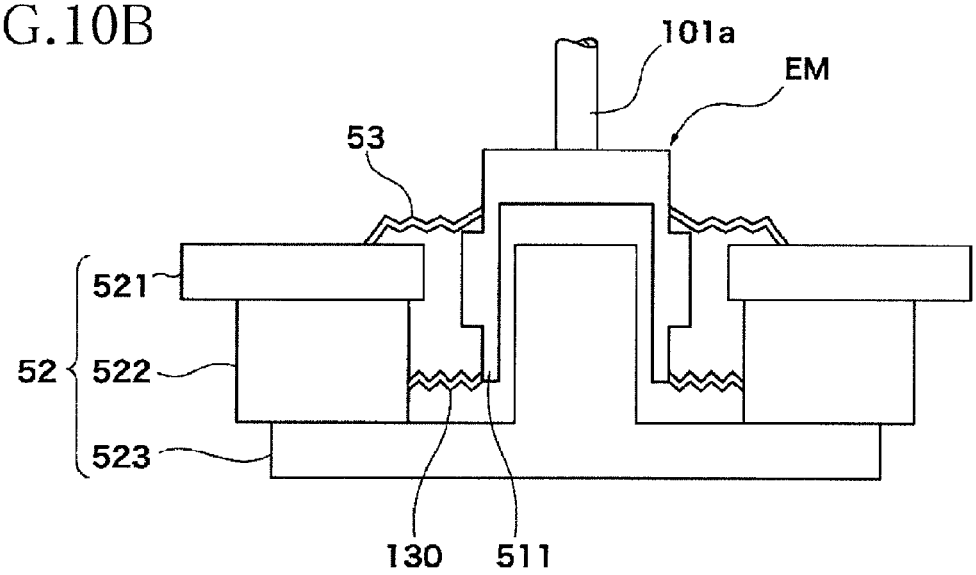

In the example of FIG. 10B, the restricting mechanism 130 is provided so as to connect the magnet 522 or a portion that is fixed relative to the magnet 522 and a lower end portion of the bobbin 511 to each other. The restricting mechanism 130 has a structure similar to that of the damper 53. In this arrangement, the restricting mechanism 130 is disposed in the magnetic-path forming portion 52 and is located at a position at which the restricting mechanism 130 is more distant from the soundboard 7 than the damper 53 is from the soundboard 7, namely, the restricting mechanism 130 is located downwardly of the damper 53.

Figure 11A:
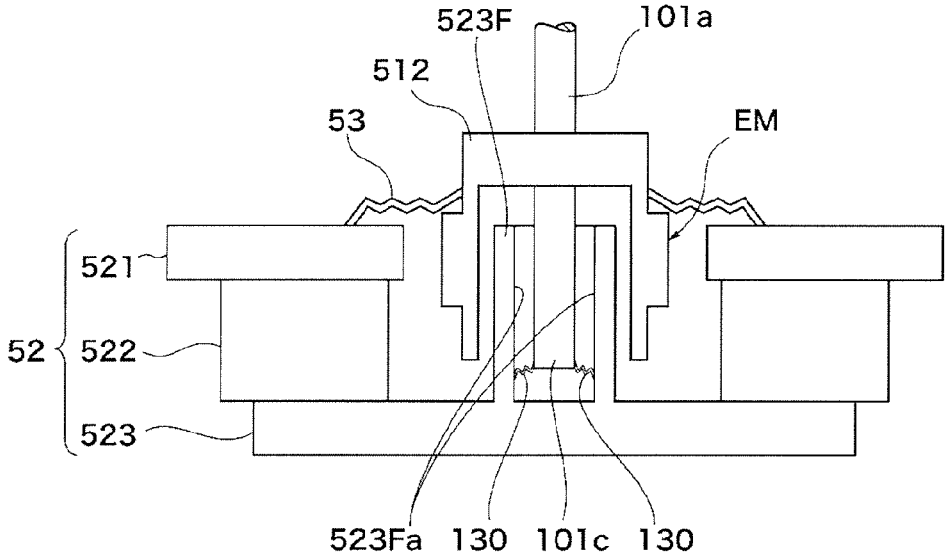
FIGS. 11A and 11B are schematic side views each showing the vicinity of the magnetic-path forming portion and the electromagnetic coupling portion in an instance in which the restricting mechanism is formed and disposed differently from the embodiment of FIG. 4.

In the example of FIG. 11A, the restricting mechanism 130 is disposed in the magnetic-path forming portion 52 and is located at a position at which the restricting mechanism 130 is more distant from the soundboard 7 than the damper 53 is from the soundboard 7, as in the example of FIG. 10B. More specifically, a hole 523Fa that extends in the Z-axis direction is formed in the cylindrical portion 523F of the yoke 523. A downwardly extending portion 101*c* that is coaxial with the rod portion 101 extends downwardly from the cap 512. The downwardly extending portion 101*c* is loosely fitted in the hole 523Fa. The restricting mechanism 130 formed similarly to the damper 53 connects a lower end of the downwardly extending portion 101*c* and an inner wall of the hole 523Fa to each other.

Figure 11B:
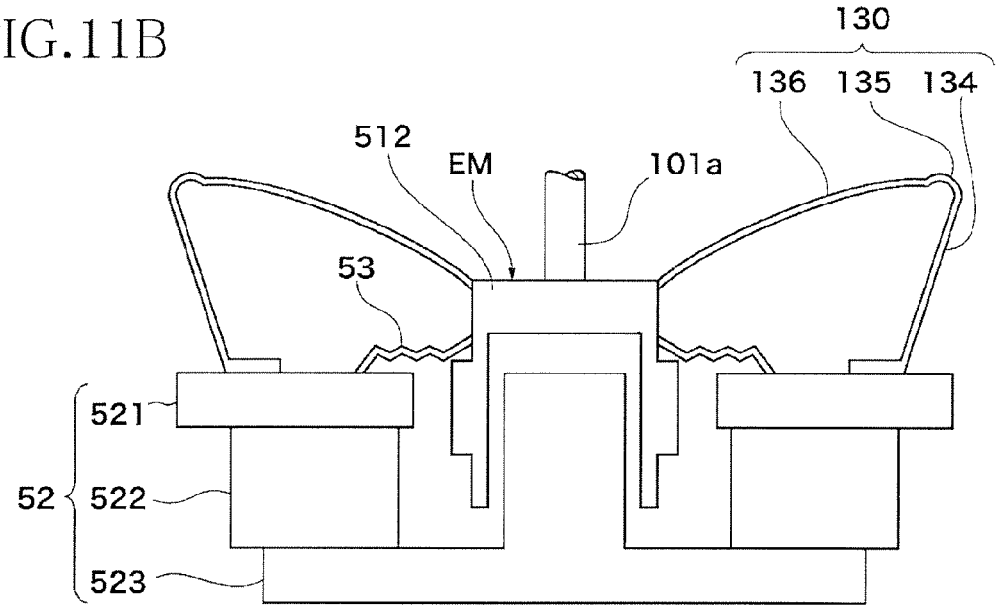

In the example of FIG. 11B, the restricting mechanism 130 is constituted by a frame 134, an edge 135, and a cone 136 similar to those provided in a speaker of a voice coil type. One end of the frame 134 is fixed to the top plate 521, one end of the cone 136 is fixed to the cap 512, and the other end of the frame 134 and the other end of the cone 136 are connected by the edge 135.

In the embodiment and the modified examples, any combination other than those illustrated above may be suitably employed. For instance, two or more restricting mechanisms 130 having different structures may be provided apart from the damper 53.

The soundboard 7 is illustrated as one example of the vibrated body to be vibrated. In addition, the invention is applicable to a structure in which any other member such as a roof or a side board that undergoes a dimensional change functions as the vibrated body to be vibrated. Even in an instance where the vibrated body does not undergo the dimensional change, the invention is useful when the vibrated body is relatively displaced by a dimensional change or deformation of a member that supports the acoustic transducer, in a direction different from or intersecting the vibration direction.

The piano to which the principle of the invention is applicable may be a grand piano or an upright piano. The present invention is applicable to not only the pianos but also various acoustic musical instruments having the acoustic transducer, electronic musical instruments having the acoustic transducer, and speakers. When the invention is applied to the acoustic musical instruments, the electronic musical instruments, and the speakers, the vibrated body that can be forcibly vibrated needs to be provided therein.

What is claimed is:

1. An installation structure for an acoustic transducer configured to operate in accordance with an audio signal for thereby vibrating a vibrated body in a first direction, so as to permit the vibrated body to generate sounds, comprising:

a magnetic-path forming portion fixedly disposed relative to a fixedly supporting portion and forming a magnetic path;

a movable unit having an electromagnetic coupling portion electromagnetically coupled to the magnetic-path forming portion, the movable unit being configured to vibrate in the first direction when the electromagnetic coupling portion is driven by the magnetic-path forming portion in response to a drive signal based on the audio signal;

a connector fixed to the vibrated body, the connector connecting the movable unit to the vibrated body for transmitting vibration of the movable unit to the vibrated body; and at least two restricting mechanisms fixedly disposed relative to the fixedly supporting portion and configured to restrict a movement of the movable unit in a second direction that intersects the first direction.

2. The installation structure for the acoustic transducer according to claim 1, wherein two of the at least two restricting mechanisms engage the movable unit at mutually different positions in the first direction.

3. The installation structure for the acoustic transducer according to claim 1, wherein at least one of the at least two restricting mechanisms is a damper.

4. The installation structure for the acoustic transducer according to claim 1, wherein two of the at least two restricting mechanisms include: a first restricting mechanism; and a second restricting mechanism that engages the movable unit at a position in the first direction at which the second restricting mechanism is closer to the vibrated body than the first restricting mechanism is to the vibrated body, and wherein the second restricting mechanism is fixed to the fixedly supporting portion via the magnetic-path forming portion, the second restricting mechanism having a holding portion that extends to a position in the first direction at which the holding portion is closer to the vibrated body than the first restricting mechanism is to the vibrated body and an engaging portion held by the holding portion and engaging the movable unit.

5. The installation structure for the acoustic transducer according to claim 4, wherein the engaging portion is formed of a fiber member.

6. The installation structure for the acoustic transducer according to claim 1, wherein each of the at least two restricting mechanisms engages the movable unit at a position in the first direction at which each of the at least two restricting mechanisms is closer to the magnetic-path forming portion than to the vibrated body.

7. The installation structure for the acoustic transducer according to claim 1, wherein at least one of the at least two restricting mechanisms has an engaging portion formed of a fiber member or an elastic member and configured to restrict, by contacting the movable unit, the movement of the movable unit in the second direction that intersects the first direction.

8. The installation structure for the acoustic transducer according to claim 1, further comprising at least one permission mechanism provided on at least one of the movable unit and the connector, the at least one permission mechanism being disposed between: the vibrated body; and the closest engaging position that is the closest to the connector among engaging portions at which the at least two restricting mechanisms respectively engage the movable unit, wherein the at least one permission mechanism is configured to permit at least a portion of the movable unit located on one of opposite sides of the closest engaging portion nearer to the connector to incline with respect to the first direction when the connector is displaced relative to the fixedly supporting portion within a predetermined range.

9. The installation structure for the acoustic transducer according to claim 1, wherein the at least two restricting mechanisms are configured to restrict a movement of the electromagnetic coupling portion relative to the magnetic-path forming portion in the second direction.

10. The installation structure for the acoustic transducer according to claim 1, wherein the at least two restricting mechanisms are configured to restrict the movement of the movable unit such that an axis of the movable unit and an axis of a yoke of the magnetic path forming portion are coaxially aligned with each other.

* * * * *